US010551788B2

(12) United States Patent
Hiratsuka

(10) Patent No.: US 10,551,788 B2
(45) Date of Patent: Feb. 4, 2020

(54) IMAGE FORMING APPARATUS AND CARTRIDGE UNIT HAVING A HELMHOLTZ RESONATOR

(71) Applicant: CANON KABUSHIKI KAISHA, Tokyo (JP)

(72) Inventor: Takashi Hiratsuka, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/154,150

(22) Filed: Oct. 8, 2018

(65) Prior Publication Data

US 2019/0137927 A1 May 9, 2019

(30) Foreign Application Priority Data

Nov. 6, 2017 (JP) ..... 2017-214159

(51) Int. Cl.

| | |
|---|---|
| ***G03G 21/16*** | (2006.01) |
| ***G10K 11/172*** | (2006.01) |
| ***G03G 21/18*** | (2006.01) |
| ***G10K 11/00*** | (2006.01) |

(52) U.S. Cl.

CPC ..... *G03G 21/1619* (2013.01); *G03G 21/1842* (2013.01); *G10K 11/002* (2013.01); *G10K 11/172* (2013.01); *G03G 21/1633* (2013.01); *G10K 2210/32272* (2013.01)

(58) Field of Classification Search

CPC ..... G03G 21/1619
USPC ..... 399/91
See application file for complete search history.

(56) References Cited

U.S. PATENT DOCUMENTS

2013/0260952 A1* 10/2013 Matsuda et al.
2016/0349695 A1* 12/2016 Ishida et al.

FOREIGN PATENT DOCUMENTS

JP 2001117451 A 4/2001
JP 2016033646 A 3/2016

* cited by examiner

*Primary Examiner* — Walter L Lindsay, Jr.
*Assistant Examiner* — Philipmarcus T Fadul
(74) *Attorney, Agent, or Firm* — Canon U.S.A., Inc. IP Division

(57) ABSTRACT

An image forming apparatus includes a cartridge unit and a cartridge support member. The cartridge unit includes a photosensitive drum on a surface of which an electrostatic latent image is to be formed. The cartridge support member supports the cartridge unit inside an apparatus main body. The cartridge unit is detachable from the apparatus main body. In a case where the cartridge unit is attached to the apparatus main body, a Helmholtz resonator including a communication portion and including a cavity portion is constituted of the cartridge unit and the cartridge support member. The cartridge unit includes at least a part of the communication portion of the Helmholtz resonator.

15 Claims, 7 Drawing Sheets

IMAGE FORMING APPARATUS AND CARTRIDGE UNIT HAVING A HELMHOLTZ RESONATOR

BACKGROUND OF THE INVENTION

Field of the Invention

The present disclosure relates to an image forming apparatus including a Helmholtz resonator and a cartridge attached to the image forming apparatus.

Description of the Related Art

Image forming apparatuses such as copying machines and printers generate operation sounds by operation of motors, fans, and the like when forming images. On the other hand, there is a strong customer demand for silencing of image forming apparatuses recently.

As a configuration for reducing an operation sound of an image forming apparatus, image forming apparatuses equipped with Helmholtz resonators are discussed (Japanese Patent Applications Laid-Open No. 2016-33646 and No. 2001-117451). A Helmholtz resonator is constituted of a cavity portion of which a volume is determined based on a frequency band of a sound to be silenced and a communication portion communicating the cavity portion and an outside.

According to the configuration described in Japanese Patent Application Laid-Open No. 2016-33646, the Helmholtz resonator is constituted of a multiple structure in which plate-shaped members are piled on an exterior opening and closing cover. However, the cavity portion of the Helmholtz resonator is formed by attaching the plate-shaped members, which are separate members, to the exterior opening and closing cover, so that a member configuration is complicated than a state including only the exterior opening and closing cover.

According to the configuration described in Japanese Patent Application Laid-Open No. 2001-117451, a space inside a photosensitive drum of the image forming apparatus is configured as the cavity portion of the Helmholtz resonator. Thus, the Helmholtz resonator can be arranged without complicating the member configuration. On the other hand, a cylinder portion of the photosensitive drum is vibrated by application of a charge bias or a development bias and generates a high frequency sound. Such a high frequency sound is emitted from the cylinder of the photosensitive drum and difficult to be guided to a communication portion of the Helmholtz resonator arranged inside the cylinder, so that a silencing effect is hardly obtained.

SUMMARY OF THE INVENTION

According to an aspect of the present disclosure, an image forming apparatus includes a cartridge unit including a photosensitive drum on a surface of which an electrostatic latent image is to be formed, and a cartridge support member configured to support the cartridge unit inside an apparatus main body, wherein the cartridge unit is configured to be detachable from the apparatus main body, wherein, in a case where the cartridge unit is attached to the apparatus main body, a Helmholtz resonator including a communication portion and including a cavity portion is constituted of the cartridge unit and the cartridge support member, and wherein the cartridge unit includes at least a part of the communication portion of the Helmholtz resonator.

According to the present disclosure, an image forming apparatus can perform silencing by a Helmholtz resonator while saving a space.

Further features of the present disclosure will become apparent from the following description of embodiments with reference to the attached drawings.

DESCRIPTION OF THE EMBODIMENTS

Various embodiments of the present disclosure will be described in detail below with reference to the attached drawings. However, dimensions, materials, shapes, and relative arrangements of components described in the below embodiments are to be appropriately changed depending on a configuration and various conditions of an apparatus to which the present disclosure is applied. Thus, unless otherwise specifically stated, the scope of the present disclosure is not limited only to the embodiments described below.

Figure 1:
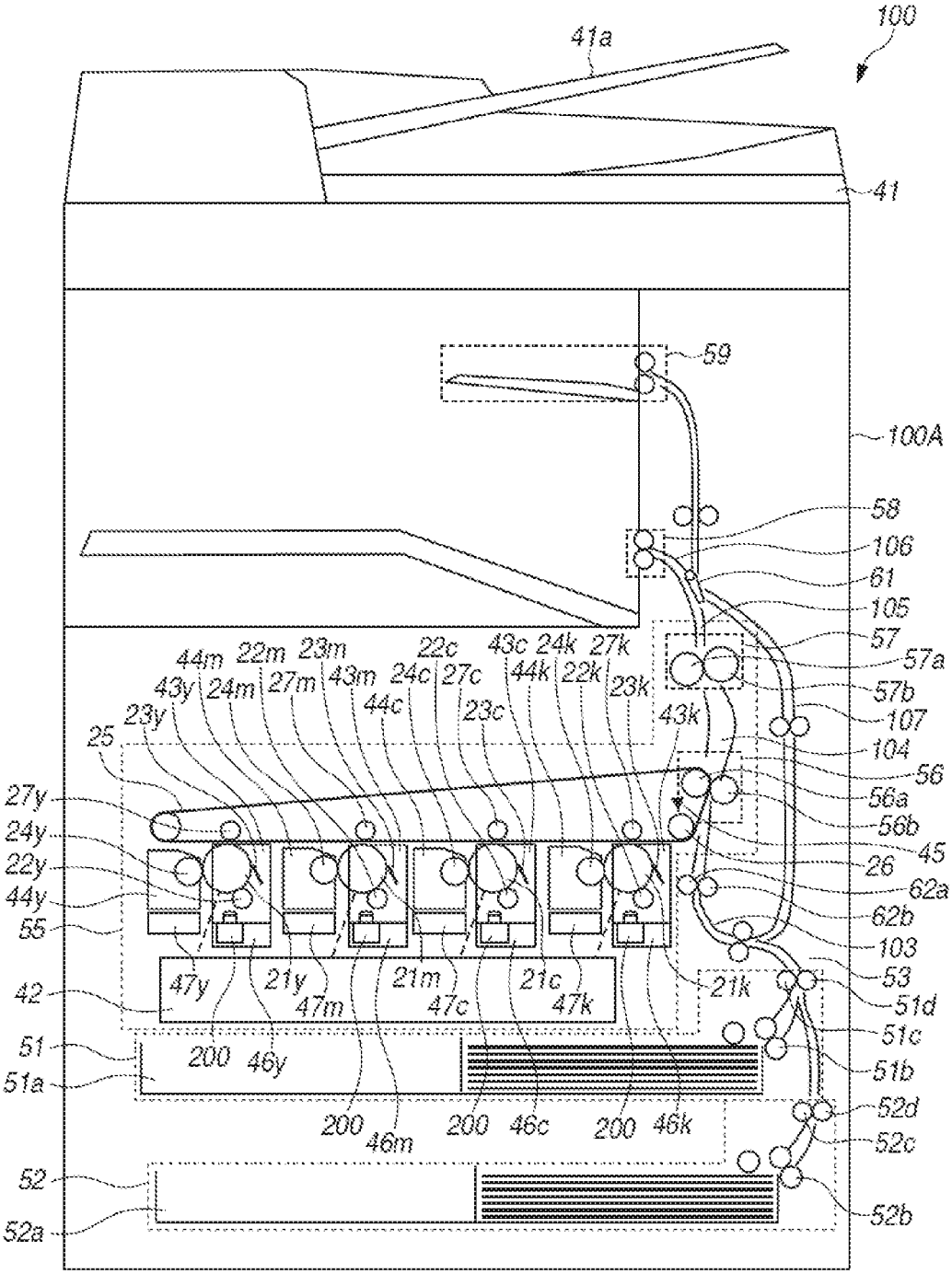
FIG. 1 illustrates a schematic configuration of an image forming apparatus.

FIG. 1 illustrates a schematic configuration of an image forming apparatus according to the present embodiment.

In FIG. 1, an image forming apparatus 100 includes an image forming apparatus main body 100A (hereinbelow, referred to as the apparatus main body) and an image reading unit 41 provided on an upper part of the apparatus main body 100A. The image reading unit 41 includes an image sensor which illuminates a document placed on a platen glass as a document positioning plate with light and converts reflected light therefrom into a digital signal. A document to be read an image thereof is conveyed onto the platen glass by an automatic document feeding device 41*a*. The apparatus main body 100A includes an image forming unit 55, sheet feeding devices 51 and 52 for feeding a sheet to the image forming unit 55, and a sheet reversing unit 59 for reversing and conveying the sheet to the image forming unit 55.

The image forming unit 55 includes image forming units for forming four color toner images of yellow (Y), magenta (M), cyan (C) and black (Bk). In the following description, when components of the respective image forming units are distinguished, y, m, c, and k are attached to ends of reference numerals. When the components are not distinguished, the suffixes y, m, c, and k are omitted.

The image forming unit 55 includes an exposure unit 42, four photosensitive drum cartridges 43 (43*y*, 43*m*, 43*c*, and 43*k*), and four development cartridges 44 (44*y*, 44*m*, 44*c*, and 44*k*). The image forming unit 55 further includes an intermediate transfer unit 45, a secondary transfer unit 56, and a fixing unit 57 which are arranged above the photosensitive drum cartridges 43 and the development cartridges 44. The photosensitive drum cartridges 43 are examples of a cartridge unit according to the present embodiment.

The photosensitive drum cartridges 43 respectively include photosensitive drums 21 (21*y*, 21*m*, 21*c*, and 21*k*), charging rollers 22 (22*y*, 22*m*, 22*c*, and 22*k*), and drum cleaning blades 23 (23*y*, 23*m*, 23*c*, and 23*k*). The photosensitive drums 21 are configured to be rotatable in a clockwise direction in FIG. 1. The photosensitive drum cartridges 43 are configured to be detachable from the apparatus main body 100A. The photosensitive drum cartridges 43 are supported inside the apparatus main body 100A by drum cartridge support members 46 (46*y*, 46*m*, 46*c*, and 46*k*) included in the apparatus main body 100A. The photosensitive drum cartridges 43 can be withdrawn to a front direction of a sheet surface of FIG. 1 and can be attached to a depth direction of the sheet surface of FIG. 1.

When air passes over or in a cavity, the passing air may cause the cavity to oscillate with increased amplitude at specific frequencies. The phenomenon, called Helmholtz resonance, may also be indicted by a vibrating system or force external applied to the cavity. In the image forming unit 55 according to the present embodiment, a Helmholtz resonator 200 is constituted of the photosensitive drum cartridges 43 and the drum cartridge support members 46. The configuration is described in detail below.

The development cartridges 44 respectively include developing rollers 24 (24*y*, 24*m*, 24*c*, and 24*k*). The development cartridges 44 are configured to be insertable into and drawable from the apparatus main body 100A and respectively supported by development cartridge support members 47 (47*y*, 47*m*, 47*c*, and 47*k*) included in the apparatus main body 100A.

The intermediate transfer unit 45 includes an intermediate transfer belt 25 stretched around a belt drive roller 26, a secondary transfer inner roller 56*a*, and the like and primary transfer rollers 27 (27*y*, 27*m*, 27*c*, and 27*k*) abutting on the intermediate transfer belt 25 at positions facing the respective photosensitive drums 21. The primary transfer rollers 27 apply transfer biases having a positive polarity to the intermediate transfer belt 25 as described below, and thus toner images having a negative polarity on the photosensitive drums 21 are sequentially and multiply transferred to the intermediate transfer belt 25. Accordingly, a full-color image is formed on the intermediate transfer belt 25.

The secondary transfer unit 56 is constituted of the secondary transfer inner roller 56*a* and a secondary transfer outer roller 56*b* being in contact with the secondary transfer inner roller 56*a* via the intermediate transfer belt 25. The secondary transfer outer roller 56*b* is applied with a secondary transfer bias having a positive polarity as described below, and thus the full-color image formed on the intermediate transfer belt 25 is transferred to the sheet.

The fixing unit 57 includes a fixing roller 57*a* and a fixing backup roller 57*b*. The sheet is nipped and conveyed between the fixing roller 57*a* and the fixing backup roller 57*b*, and thus the toner image on the sheet is pressed, heated, and fixed on the sheet.

The sheet feeding devices 51 and 52 respectively include cassettes 51*a* and 52*a* as storage units for storing the sheets. Further, the sheet feeding devices 51 and 52 respectively include sheet separation feeding units 51*b* and 52*b* having a function of separating the sheets stored in the cassettes 51*a* and 52*a* by frictional force and feeding the sheet one by one.

In FIG. 1, a pre-secondary transfer conveyance path 103 is a path for conveying the sheet fed from the cassette 51*a* or 52*a* up to the secondary transfer unit 56. A pre-fixation conveyance path 104 is a path for conveying the sheet conveyed up to the secondary transfer unit 56 from the secondary transfer unit 56 up to the fixing unit 57. A post-fixation conveyance path 105 is a path for conveying the sheet conveyed up to the fixing unit 57 from the fixing unit 57 up to a switching member 61. A sheet discharge path 106 is a path for conveying the sheet conveyed up to the switching member 61 from the switching member 61 up to a sheet discharge unit 58. A refeeding path 107 is a path for conveying the sheet reversed by the sheet reversing unit 59 again to the image forming unit 55 so as to form an image on a back surface of the sheet which has an image formed by the image forming unit 55 on one surface.

Next, an image forming operation of the image forming apparatus 100 having the above-described configuration is described. When an image forming operation is started, the exposure unit 42 first irradiates surfaces of the photosensitive drums 21 with laser beams based on image information from a personal computer (not illustrated) and the like. At that time, the surfaces of the photosensitive drums 21 are uniformly charged to predetermined polarity and potential by the charging rollers 22, and when being irradiated with the laser beams, the charges of portions irradiated with the laser beams are attenuated, so that electrostatic latent images are formed on the photosensitive drum surfaces.

Subsequently, the developing rollers 24 are applied with a predetermined potential and respectively supply yellow (Y), magenta (M), cyan (C), and black (Bk) toners, so that the electrostatic latent images are developed as toner images. The toner images of respective colors are sequentially transferred to the intermediate transfer belt 25 by primary transfer biases applied to the respective primary transfer rollers 27, and thus a full-color toner image is formed on the intermediate transfer belt 25.

On the other hand, in parallel with the toner image forming operation, the sheet feeding device 51 or 52 separates and feeds only one of the sheets from the cassette 51*a* or 52*a* by the sheet separation feeding unit 51*b* or 52*b*. The sheet then reaches a pair of drawing rollers 51*c* and 51*d*. Further, the sheet nipped by the pair of drawing rollers 51*c* and 51*d* is conveyed to the pre-secondary transfer conveyance path 103 after sheet thickness detection by a sheet thickness detection unit 53 and abuts on a pair of registration rollers 62*a* and 62*b* which are stopped, so that a leading edge position of the sheet is adjusted.

Next, the pair of registration rollers 62*a* and 62*b* is driven at a timing when positions of the full-color toner image on the intermediate transfer belt and the sheet are matched with each other in the secondary transfer unit 56. Thus, the sheet is conveyed to the secondary transfer unit 56, and the full-color toner image is collectively transferred to the sheet by a secondary transfer bias applied to the secondary transfer outer roller 56*b* at the secondary transfer unit 56.

The sheet on which the full-color toner image is transferred is conveyed to the fixing unit 57 and applied with heat and pressure at the fixing unit 57, so that the respective color toners are melted, mixed, and fixed as the full-color image on the sheet. Subsequently, the sheet on which the image is fixed is discharged by the sheet discharge unit 58 disposed downstream of the fixing unit 57. When images are formed on both sides of the sheet, a conveyance direction of the sheet is reversed by the sheet reversing unit 59, and the sheet is conveyed again to the image forming unit 55.

Figure 2:
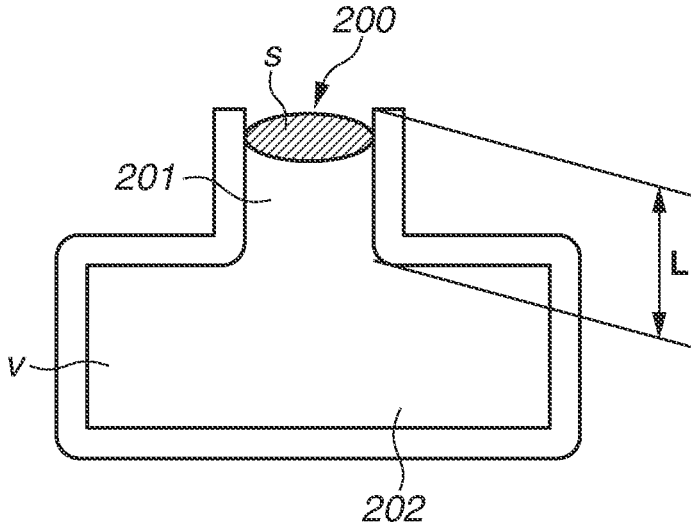
FIG. 2 is a schematic diagram of a Helmholtz resonator.

Next, a structure of the Helmholtz resonator 200 included in the image forming apparatus 100 of the present disclosure is described with reference to FIG. 2. FIG. 2 is a schematic diagram of the Helmholtz resonator 200.

The Helmholtz resonator 200 roughly includes a cavity portion 202 having a space of a volume V and a communication portion 201 having a length L extended from the cavity portion 202 and an opening having a cross sectional area S. A mass of air in the communication portion 201 is vibrated by an air spring formed by the space in the cavity portion 202 and resonates, so that a specific frequency f of a sound entering the communication portion 201 is silenced. The specific frequency f to be silenced is expressed by a formula (1).

[Formula 1]

$$f = \frac{c}{2\pi}\sqrt{\frac{S}{V(L+\Delta L)}} \tag{1}$$

In the formula (1), "c" represents the speed of sound, and ΔL which represents an opening end correction is 1.6a ("a" is a radius when the cross section of the communication portion 201 is regarded as a circle).

According to the present disclosure, a high frequency sound generated from a cylinder portion (not illustrated) of the photosensitive drums 21 is a silencing target, and the parameters of the Helmholtz resonator 200 are determined so that a frequency of the generated high frequency sound is matched with the specific frequency f of the formula (1).

Next, a first embodiment of the image forming apparatus 100 applied with the present disclosure is described.

Figure 3:
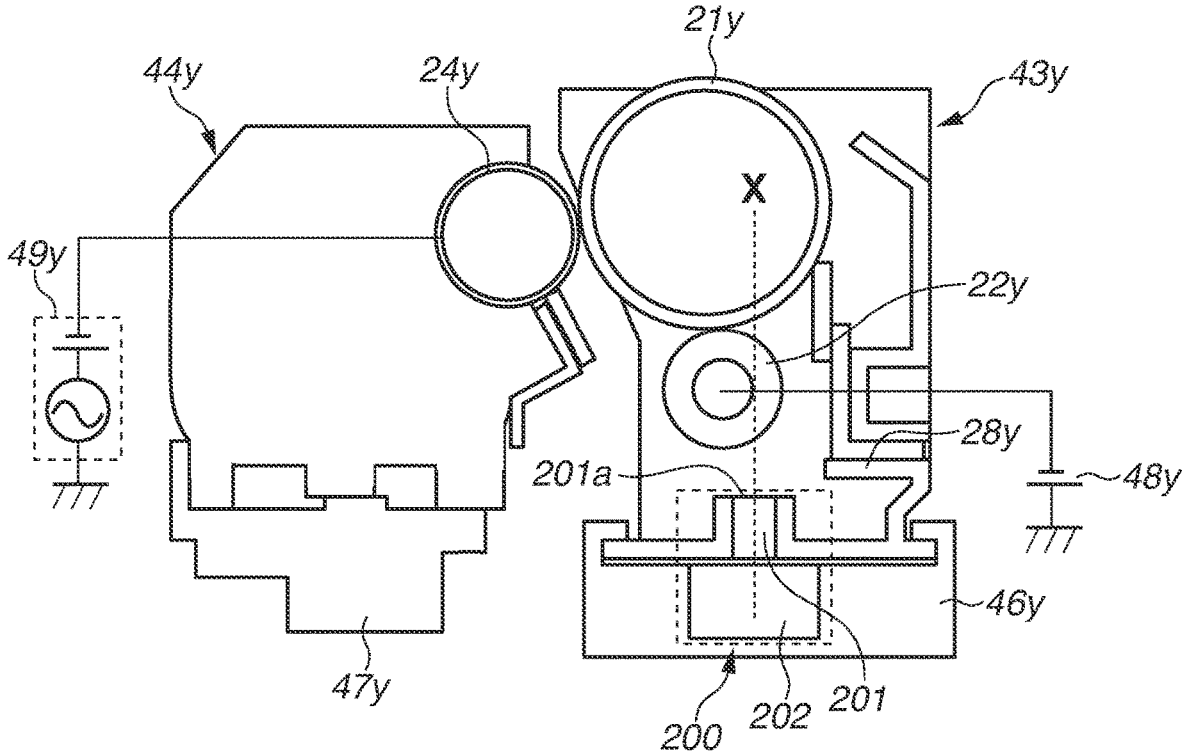
FIG. 3 is a cross-sectional schematic view near a photosensitive drum cartridge of an image forming unit according to a first embodiment.

FIG. 3 is a cross-sectional schematic view near the photosensitive drum cartridge 43*y* of the image forming unit 55 according to the first embodiment. FIG. 3 is a cross-sectional view vertical to a rotation shaft of the photosensitive drum 21*y*. Configurations near the respective photosensitive drum cartridges 43 *m*, 43*c*, and 43*k* of magenta, cyan, and black are similar to the configuration near the photosensitive drum cartridge 43*y*, so that the descriptions thereof are omitted.

As illustrated in FIG. 3, the photosensitive drum cartridge 43*y* and the development cartridge 44*y* are arranged adjacent to each other. As described above, the photosensitive drum cartridge 43*y* is insertable into and drawable from the apparatus main body 100A and supported by the drum cartridge support member 46*y* included in the apparatus main body 100A. Similarly, the development cartridge 44*y* is insertable into and drawable from the apparatus main body 100A and supported by the development cartridge support member 47*y* included in the apparatus main body 100A.

The charging roller 22*y* included in the photosensitive drum cartridge 43*y* is electrically connected to a negative polarity direct current (DC) high-voltage power source 48*y* and charges a surface of the photosensitive drum 21*y* while being in contact with the photosensitive drum 21*y* included in the photosensitive drum cartridge 43*y*. The photosensitive drum 21*y* has a photosensitive layer and the like formed on a surface of a drum cylinder.

The developing roller 24*y* included in the development cartridge 44*y* is electrically connected to a high-voltage power source 49*y* which outputs a negative polarity voltage in which a DC component is superimposed on an alternating current (AC) component of about 2 kHz. In addition, yellow developer containing yellow toner (not illustrated) is supplied to a surface of the developing roller 24*y*. The developing roller 24*y* is applied with a voltage from the high-voltage power source 49*y* and thus forms a toner image on the photosensitive drum 21*y* while bringing the yellow developer into contact with the photosensitive drum 21*y*.

When a toner image is formed on the photosensitive drum 21*y*, the photosensitive drum 21*y* is vibrated by an influence of a voltage of an AC component applied to the developing roller 24*y* at a frequency of the AC component. As a result of the vibration, the photosensitive drum 21*y* generates a sound having a frequency of the vibration.

On the other hand, the Helmholtz resonator 200 is constituted of the photosensitive drum cartridge 43*y* and the drum cartridge support member 46*y* as described above. With respect to the Helmholtz resonator 200 according to the first embodiment, various parameters are determined based on a sound of the above-described photosensitive drum 21*y* being vibrated by the developing roller 24*y* as the silencing target.

A detailed structure of the Helmholtz resonator 200 according to the first embodiment is described.

The communication portion 201 of the Helmholtz resonator 200 is formed in a drum cartridge frame 28*y* included in the photosensitive drum cartridge 43*y*. The cavity portion 202 of the Helmholtz resonator 200 is formed in the drum cartridge support member 46*y*. As illustrated in FIG. 3, the communication portion 201 and the cavity portion 202 are arranged on positions spatially communicated with each other in a state in which the photosensitive drum cartridge 43*y* is inserted into the apparatus main body 100A. The photosensitive drum cartridge 43*y* is inserted into the apparatus main body 100A, and thus the Helmholtz resonator 200 including the communication portion 201 and the cavity portion 202 is configured.

According to the present embodiment, the photosensitive drum cartridge 43*y* entirely includes the communication portion 201, and the drum cartridge support member 46*y* entirely includes the cavity portion 202. The Helmholtz resonator 200 is configured according to the present embodiment and thus can be arranged without increasing the number of parts of the photosensitive drum cartridges 43 which are consumable members.

In addition, the Helmholtz resonator 200 can be arranged near the photosensitive drums 21 as a sound source. The communication portion 201 faces toward a direction of the photosensitive drum 21*y* in a cross section viewed from a rotation shaft direction of the photosensitive drum 21*y* as illustrated in FIG. 3. In other words, when a virtual line X is drawn vertically to an opening surface 201*a* of the communication portion 201, the virtual line X intersects the photosensitive drum 21*y*. Thus, it is easy to guide a sound toward the communication portion 201 of the Helmholtz resonator 200, and accordingly, silencing can be effectively performed.

According to the first embodiment, a silencing frequency of the Helmholtz resonator 200 is that of a sound of the photosensitive drum 21*y* being vibrated by the developing roller 24*y*, however, the present disclosure is not limited to the sound. When an AC voltage is applied to the charging roller 22*y*, the photosensitive drums 21 is also vibrated at the AC frequency. In this case, a sound of vibration by the charging roller 22*y* may be regarded as the silencing target.

In FIG. 3 of the first embodiment, the Helmholtz resonator 200 is arranged in one position, however, the present disclosure is not limited to the one position. For example, a plurality of the Helmholtz resonators 200 may be arranged in a depth direction or a cross section direction of FIG. 3.

Next, a second embodiment of the image forming apparatus 100 applied with the present disclosure is described.

Figure 4:
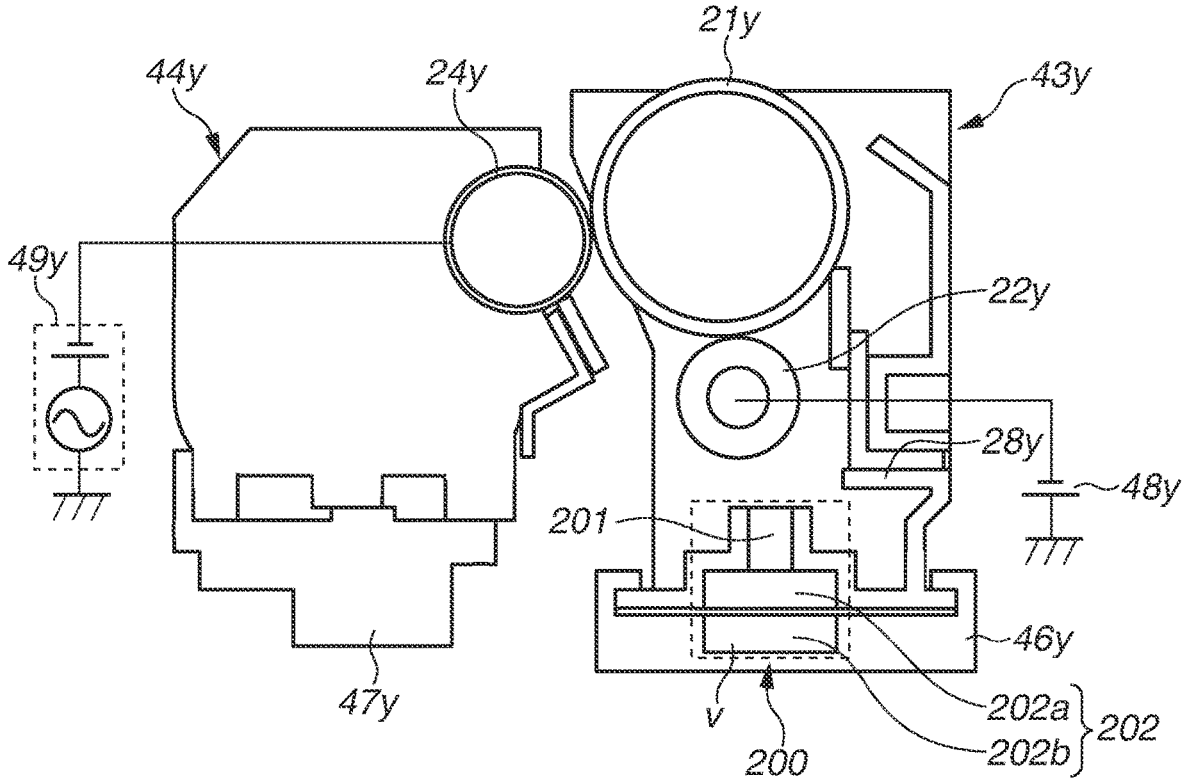
FIG. 4 is a cross-sectional schematic view near a photosensitive drum cartridge of an image forming unit according to a second embodiment.

FIG. 4 is a cross-sectional schematic view near the photosensitive drum cartridge 43*y* of the image forming unit 55 according to the second embodiment. The second embodiment is different from the first embodiment in the detailed structure of the Helmholtz resonator 200.

As illustrated in FIG. 4, the communication portion 201 of the Helmholtz resonator 200 according to the second embodiment is formed in the drum cartridge frame 28*y* included in the photosensitive drum cartridge 43*y*. Further, the cavity portion 202 of the Helmholtz resonator 200 is constituted of a cavity portion 202*a* formed in the photosensitive drum cartridge 43*y* and a cavity portion 202*b* formed in the drum cartridge support member 46*y*. The cavity portion 202*a* is spatially communicated with the communication portion 201.

As illustrated in FIG. 4, the cavity portion 202*a* and the cavity portion 202*b* are fitted with each other and form the cavity portion 202 as a cuboid space having the volume V in a state in which the photosensitive drum cartridge 43*y* is inserted into the apparatus main body 100A.

The Helmholtz resonator 200 is configured according to the second embodiment and thus can be arranged in the image forming unit 55 in a case in which the cavity portion 202 cannot be fitted in the drum cartridge support member 46*y* in the area.

Next, a third embodiment of the image forming apparatus 100 applied with the present disclosure is described.

Figure 5:
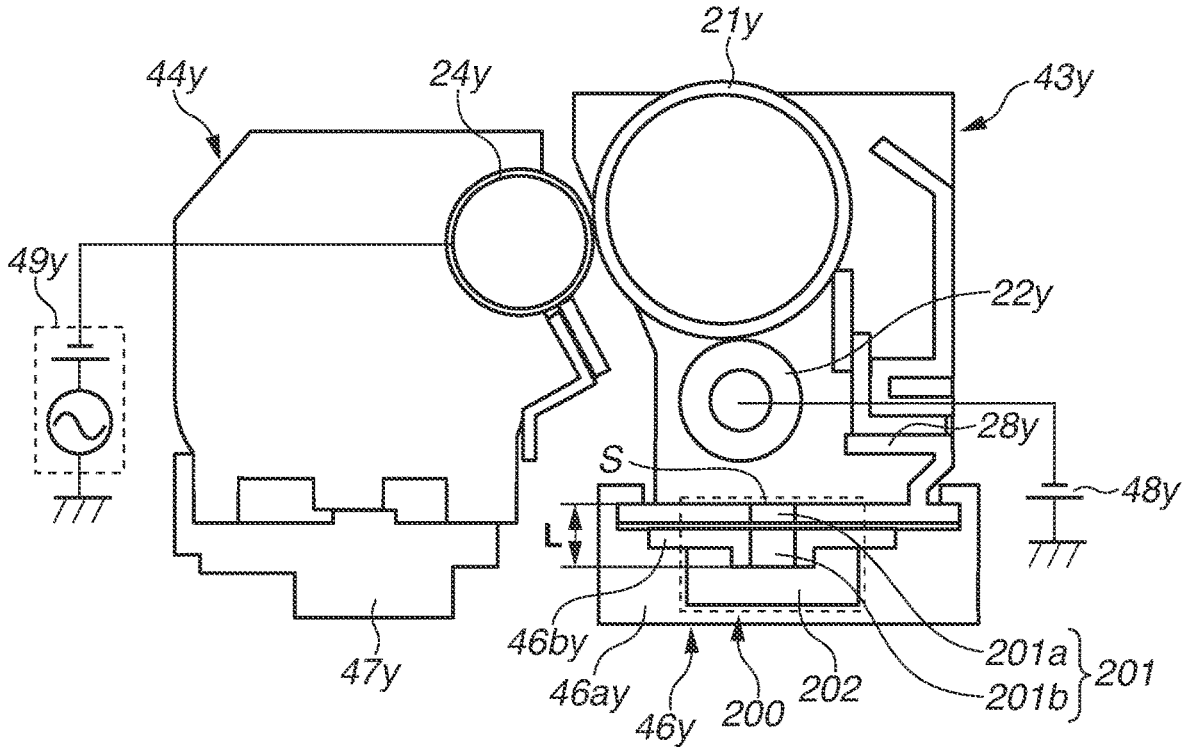
FIG. 5 is a cross-sectional schematic view near a photosensitive drum cartridge of an image forming unit according to a third embodiment.

FIG. 5 is a cross-sectional schematic view near the photosensitive drum cartridge 43*y* of the image forming unit 55 according to the third embodiment. The third embodiment is different from the first and the second embodiments in the detailed structure of the Helmholtz resonator 200.

As illustrated in FIG. 5, the communication portion 201 of the Helmholtz resonator 200 is constituted of the opening surface 201*a* formed in the drum cartridge frame 28*y* and a communication portion 201*b* formed in an auxiliary support member 46*by* of the drum cartridge support member 46*y*. Further, the cavity portion 202 of the Helmholtz resonator 200 is formed in a main support member 46*ay* of the drum cartridge support member 46*y* and arranged on a position spatially communicated with the communication portion 201*b*.

As illustrated in FIG. 5, the opening surface 201*a* and the communication portion 201*b* are fitted with each other and form the communication portion 201 having a cross sectional area S and a length L in a state in which the photosensitive drum cartridge 43*y* is inserted into the apparatus main body 100A. In the configuration of the drum cartridge support member 46*y*, the main support member 46*ay* and the auxiliary support member 46*by* may be configured as a single integrated resin part or separated parts.

According to the third embodiment, a part of the communication portion 201 is included in the drum cartridge support member 46*y*. The Helmholtz resonator 200 is configured according to the third embodiment, thus the photosensitive drum cartridge 43*y* which is a replacement unit can be made compact than that of the first and the second embodiments, and handleability of a user is improved.

Next, a fourth embodiment of the image forming apparatus 100 applied with the present disclosure is described.

Figure 6:
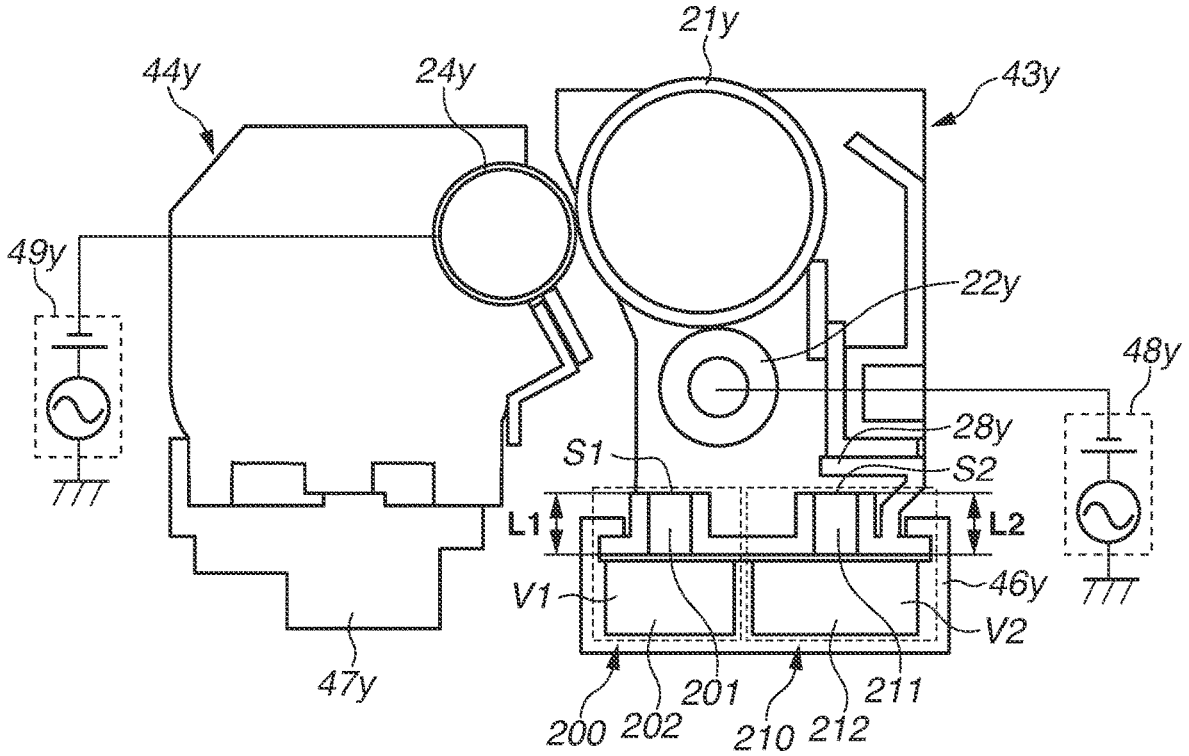
FIG. 6 is a cross-sectional schematic view near a photosensitive drum cartridge of an image forming unit according to a fourth embodiment.

FIG. 6 is a cross-sectional schematic view near the photosensitive drum cartridge 43*y* of the image forming unit 55 according to the fourth embodiment. The fourth embodiment is different from the first embodiment in that an AC voltage is applied to the charging roller 22*y* and accordingly is further added with a Helmholtz resonator 210 of which a silencing target is a sound generated by vibration of the charging roller 22*y*.

As illustrated in FIG. 6, the charging roller 22*y* included in the photosensitive drum cartridge 43*y* is electrically connected to the high-voltage power source 49*y* which outputs a negative polarity voltage in which a DC component is superimposed on an AC component of about 1 kHz. The charging roller 22*y* charges the surface of the photosensitive drum 21*y* while being in contact with the photosensitive drum 21*y* included in the photosensitive drum cartridge 43*y*.

When the surface of the photosensitive drum 21*y* is charged, the photosensitive drum 21*y* is vibrated by an influence of a voltage of an AC component applied to the charging roller 22*y* at a frequency of the AC component. In addition, a cylinder of the photosensitive drum 21*y* is also vibrated by an influence of an AC voltage having a different frequency applied to the developing roller 24*y* as described above in the first embodiment.

Accordingly, the cylinder (not illustrated) of the photosensitive drum 21*y* generates sounds having two types of frequencies caused by respective vibrations of the charging roller 22*y* and the developing roller 24*y*.

According to the present embodiment, a first Helmholtz resonator 200 and a second Helmholtz resonator 210 which respectively regard these two types of sounds as silencing targets are arranged.

The first Helmholtz resonator 200 includes a first cavity portion 202 having a space of a volume V1 and a first communication portion 201 having a length L1 extended from the first cavity portion 202 and an opening having a cross sectional area S1 and regards a sound caused by a vibration from the developing roller 24*y* as the silencing target. On the other hand, the second Helmholtz resonator 210 includes a second cavity portion 212 having a space of a volume V2 and a second communication portion 211 having a length L2 extended from the second cavity portion 212 and an opening having a cross sectional area S2 and regards a sound caused by a vibration from the charging roller 22*y* as the silencing target.

According to the present embodiment, detailed structures of the first Helmholtz resonator 200 and the second Helmholtz resonator 210 are similar to that according to the first embodiment. However, the present disclosure is not limited to this configuration, and the present embodiment may include a configuration in which the photosensitive drum cartridge 43*y* includes a part of the cavity portion 202 as with the second embodiment. Alternatively, the present embodiment may include a configuration in which the drum cartridge support member 46*y* may include a part of the communication portion 201 as with the third embodiment.

Next, a fifth embodiment of the image forming apparatus 100 applied with the present disclosure is described.

Figure 7:
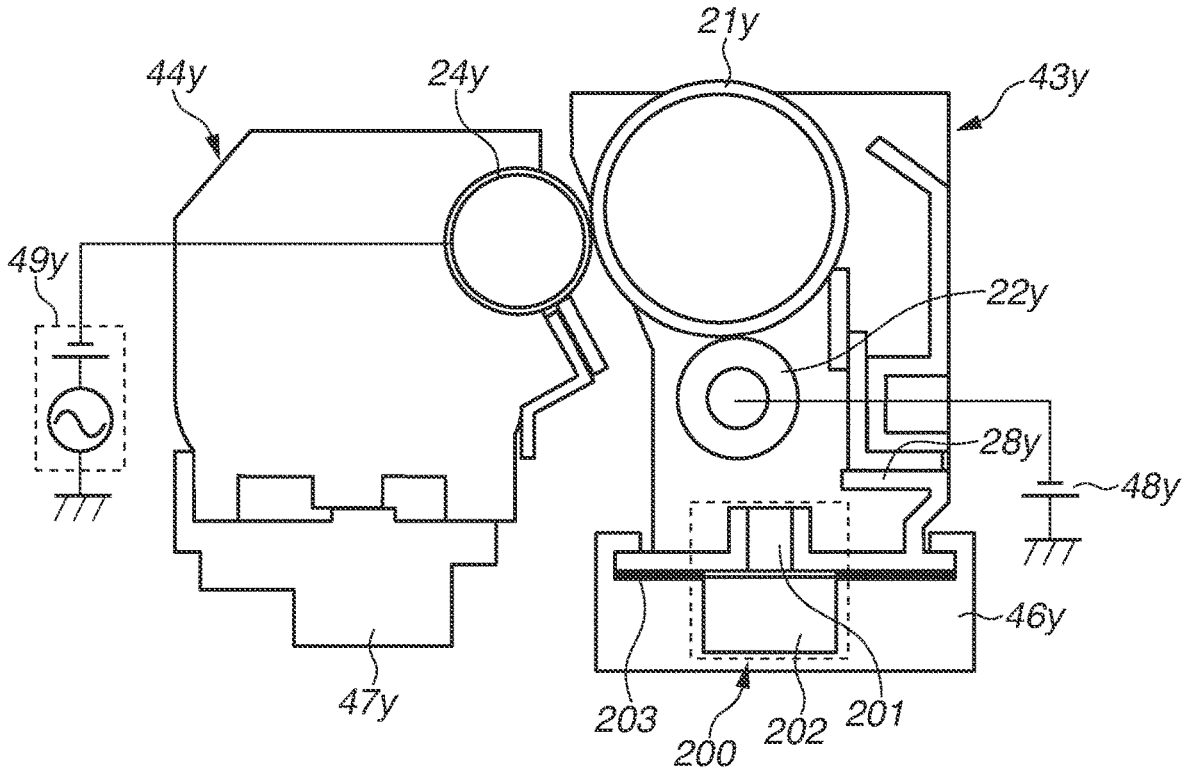
FIG. 7 is a cross-sectional schematic view near a photosensitive drum cartridge of an image forming unit according to a fifth embodiment.

FIG. 7 is a cross-sectional schematic view near the photosensitive drum cartridge 43*y* of the image forming unit 55 according to the fifth embodiment. The fifth embodiment is different from the first embodiment in that a sealing member 203 is arranged on a facing portion of the photosensitive drum cartridge 43*y* and the drum cartridge support member 46*y* in which the communication portion 201 and the cavity portion 202 are formed.

As illustrated in FIG. 7, the sealing member 203 is arranged between the communication portion 201 included in the photosensitive drum cartridge 43*y* and the cavity portion 202 included in the drum cartridge support member

46*y*. The sealing member 203 is attached to the drum cartridge support member 46*y* with an adhesive member (not illustrated).

The sealing member 203 according to the present embodiment contains elastically deformable foamed rubber as a main material. The sealing member 203 has a function of securing airtightness of the cavity portion 202 by being compressed between the drum cartridge frame 28*y* and the drum cartridge support member 46*y*.

As described above in FIG. 2, the Helmholtz resonator 200 exerts a silencing function in such a manner that a mass of air in the communication portion 201 is vibrated by the air spring formed by the space in the cavity portion 202 and resonates. The sealing member 203 secures the airtightness of the cavity portion 202, and thus the air spring formed by the space in the cavity portion 202 can reliably secure its spring property. Accordingly, the configuration according to the present embodiment can deliver higher silencing performance.

The detailed structure of the Helmholtz resonator 200 according to the present embodiment is based on that according to the first embodiment. However, the present disclosure is not limited to the configuration and may include a configuration in which the sealing member 203 is provided in a part constituting the Helmholtz resonator according to the second to the fourth embodiments.

According to the above-described embodiments, the photosensitive drum cartridge 43*y* including the photosensitive drums 21 is described as an example of a sound generation source, however, a sound generation source is not limited to this. When there is a candidate of a sound source generating a sound other than the photosensitive drums 21, a detachable cartridge unit includes a part of the Helmholtz resonator configuration, and thus the Helmholtz resonator can be arranged in the apparatus main body while saving a space.

While the present disclosure has been described with reference to embodiments, it is to be understood that the disclosure is not limited to the disclosed embodiments. The scope of the following claims is to be accorded the broadest interpretation so as to encompass all such modifications and equivalent structures and functions.

This application claims the benefit of Japanese Patent Application No. 2017-214159, filed Nov. 6, 2017, which is hereby incorporated by reference herein in its entirety.

What is claimed is:

1. An image forming apparatus comprising:

a cartridge unit including a photosensitive drum on a surface of which an electrostatic latent image is to be formed; and a cartridge support member configured to support the cartridge unit inside an apparatus main body, wherein the cartridge unit is configured to be detachable from the apparatus main body, wherein, in a case where the cartridge unit is attached to the apparatus main body, a Helmholtz resonator including a communication portion and including a cavity portion is constituted of the cartridge unit and the cartridge support member, wherein the cartridge unit includes at least a part of the communication portion of the Helmholtz resonator, and wherein the cartridge support member includes at least a part of the cavity portion of the Helmholtz resonator.

2. The image forming apparatus according to claim 1, wherein the cartridge unit includes the entire communication portion of the Helmholtz resonator, and wherein the cartridge support member includes the entire cavity portion of the Helmholtz resonator.

3. The image forming apparatus according to claim 1, wherein the cartridge unit includes the entire communication portion of the Helmholtz resonator and includes a part of the cavity portion of the Helmholtz resonator.

4. The image forming apparatus according to claim 1, wherein the cartridge support member includes a part of the communication portion of the Helmholtz resonator and includes the entire cavity portion of the Helmholtz resonator.

5. The image forming apparatus according to claim 1, wherein the Helmholtz resonator includes a first Helmholtz resonator and a second Helmholtz resonator, and a silencing frequency of the first Helmholtz resonator is different from a silencing frequency of the second Helmholtz resonator.

6. The image forming apparatus according to claim 1, wherein, in a case where the cartridge unit is attached to the apparatus main body, an elastically deformable sealing member is arranged at a facing portion of the cartridge unit and the cartridge support member constituting the Helmholtz resonator.

7. The image forming apparatus according to claim 1, wherein the photosensitive drum is configured to rotate, and wherein, in a case where the photosensitive drum is viewed from a rotation shaft direction of the photosensitive drum when the cartridge unit is attached to the apparatus main body, and a virtual line X is drawn vertical to an opening surface of the communication portion, the virtual line X intersects the photosensitive drum.

8. A cartridge unit attachable to an image forming apparatus including a cartridge support member configured to support the cartridge unit, the cartridge unit comprising: an attachment unit configured to attach the cartridge unit to the image forming apparatus, wherein, in a case where the cartridge unit is attached to an apparatus main body, a Helmholtz resonator including a communication portion and including a cavity portion is constituted of the cartridge unit and the cartridge support member, wherein the cartridge unit includes at least a part of the communication portion of the Helmholtz resonator, and wherein the cartridge support member includes at least a part of the cavity portion of the Helmholtz resonator.

9. The cartridge unit according to claim 8, wherein the cartridge unit includes at least a part of the cavity portion of the Helmholtz resonator.

10. The cartridge unit according to claim 8, wherein the cartridge unit includes the entire communication portion of the Helmholtz resonator, and wherein the cartridge support member includes the entire cavity portion of the Helmholtz resonator.

11. The cartridge unit according to claim 8, wherein the cartridge unit includes the entire communication portion of the Helmholtz resonator and includes a part of the cavity portion of the Helmholtz resonator.

12. The cartridge unit according to claim 8, wherein the cartridge support member includes a part of the communication portion of the Helmholtz resonator and includes the entire cavity portion of the Helmholtz resonator.

13. The cartridge unit according to claim 8, wherein the Helmholtz resonator includes a first Helmholtz resonator and a second Helmholtz resonator, and a silencing frequency of the first Helmholtz resonator is different from a silencing frequency of the second Helmholtz resonator.

14. The cartridge unit according to claim 8, wherein, in a case where the cartridge unit is attached to the apparatus main body, an elastically deformable sealing member is arranged at a facing portion of the cartridge unit and the cartridge support member constituting the Helmholtz resonator.

15. The cartridge unit according to claim 8, further comprising a rotatable photosensitive drum, wherein, in a case where the photosensitive drum is viewed from a rotation shaft direction of the photosensitive drum when the cartridge unit is attached to the apparatus main body, and a virtual line X is drawn vertical to an opening surface of the communication portion, the virtual line X intersects the photosensitive drum.

* * * * *